US011311787B2

(12) United States Patent
Kawar et al.

(10) Patent No.: US 11,311,787 B2
(45) Date of Patent: Apr. 26, 2022

(54) ROBOTIC TRAINING APPARATUS

(71) Applicants: Kais Jeries Kawar, Hanover park, IL (US); Zaid Almasri, Manhattan, IL (US)

(72) Inventors: Kais Jeries Kawar, Hanover park, IL (US); Zaid Almasri, Manhattan, IL (US)

( * ) Notice: Subject to any disclaimer, the term of this patent is extended or adjusted under 35 U.S.C. 154(b) by 0 days.

(21) Appl. No.: 17/536,024

(22) Filed: Nov. 27, 2021

(65) Prior Publication Data

US 2022/0080279 A1 Mar. 17, 2022

Related U.S. Application Data

(60) Provisional application No. 63/189,041, filed on May 14, 2021.

(51) Int. Cl.

| | |
|---|---|
| ***A63B 69/24*** | (2006.01) |
| ***A63B 71/06*** | (2006.01) |
| ***A63B 24/00*** | (2006.01) |

(52) U.S. Cl.

CPC ..... *A63B 69/24* (2013.01); *A63B 24/0021* (2013.01); *A63B 71/0622* (2013.01); *A63B 2024/0025* (2013.01); *A63B 2071/0647* (2013.01); *A63B 2220/10* (2013.01); *A63B 2220/836* (2013.01); *A63B 2225/093* (2013.01); *A63B 2244/10* (2013.01)

(58) Field of Classification Search

CPC . A63B 69/24; A63B 24/0021; A63B 71/0622; A63B 2024/0025; A63B 2071/0647; A63B 2220/10; A63B 2220/836; A63B 2225/093; A63B 2244/10

See application file for complete search history.

(56) References Cited

U.S. PATENT DOCUMENTS

| | | | | |
|---|---|---|---|---|
| 4,088,315 | A * | 5/1978 | Schemmel | A63B 69/34 482/84 |
| 4,765,609 | A * | 8/1988 | Wilson | A63B 69/34 482/901 |
| 8,888,662 | B1 * | 11/2014 | Gomez, Jr. | A63B 69/208 482/121 |
| 9,050,514 | B1 * | 6/2015 | Mirza | A63B 69/004 |
| 9,586,120 | B1 * | 3/2017 | Sotelo | A63H 13/06 |
| 10,953,296 | B1 * | 3/2021 | Higgins | A63B 69/20 |
| 2002/0193211 | A1 * | 12/2002 | Kao | A63B 69/34 482/83 |

(Continued)

*Primary Examiner* — Sundhara M Ganesan
(74) *Attorney, Agent, or Firm* — Barry Choobin; Patent 360

(57) ABSTRACT

A robotic training apparatus for martial arts and combat sports that is of a dimension like a punching bag and can be hung or mounted on a floor. The apparatus includes a frame, an upper revolving member and a lower revolving member mounted to the frame, wherein the two members can revolve independently of each other along a vertical axis. A pair of robotic arms coupe to the upper revolving member can be actuated to resemble a punching action. A pair of robotic legs coupled to the lower revolving member can be actuated to resemble a kicking action. Both the pair of robotic arms and the pair of robotic legs horizontally extends from the upper revolving member and the lower revolving member respectively.

18 Claims, 6 Drawing Sheets

(56) References Cited

U.S. PATENT DOCUMENTS

2008/0015093 A1* 1/2008 Helton ..... A63B 69/345
482/83
2008/0119335 A1* 5/2008 Luigi ..... A63B 69/34
482/84
2011/0111924 A1* 5/2011 Jones ..... G09B 19/0038
482/8
2011/0287397 A1* 11/2011 Hwu ..... A63B 21/00181
434/247
2012/0108394 A1* 5/2012 Jones ..... A63B 69/201
482/84
2012/0214648 A1* 8/2012 Schlicher ..... A63B 69/203
482/87
2014/0090153 A1* 4/2014 Siklosi ..... A42B 3/125
2/424
2014/0128226 A1* 5/2014 Chang ..... A63B 71/023
482/83
2014/0243165 A1* 8/2014 Hall ..... A63B 69/20
482/83
2014/0378281 A1* 12/2014 Mazi ..... B25J 11/00
482/83
2015/0375078 A1* 12/2015 Chen ..... A63B 24/0087
472/29
2018/0233068 A1* 8/2018 Kraus ..... G09B 19/003
2019/0143189 A1* 5/2019 Elmore ..... A63B 69/345
473/438
2019/0224550 A1* 7/2019 Shoshan ..... A63B 69/34
2019/0255411 A1* 8/2019 He ..... A63B 69/004
2020/0038731 A1* 2/2020 Diaz ..... A63B 69/34
2020/0215403 A1* 7/2020 Nader ..... A63B 69/20
2021/0106896 A1* 4/2021 Fountaine ..... A63B 6/00
2021/0283482 A1* 9/2021 Wu ..... A63B 71/023
2021/0394036 A1* 12/2021 Yachin ..... A63B 24/0084
2021/0402277 A1* 12/2021 Tartuffe ..... A63B 69/004
2022/0016509 A1* 1/2022 Fazio ..... A63B 71/023

* cited by examiner

ROBOTIC TRAINING APPARATUS

CROSS-REFERENCE TO RELATED APPLICATIONS

This application claims priority from the U.S. provisional patent application Ser. No. 63/189,041, filed on May 14, 2021, which is incorporated herein by reference in its entirety.

FIELD OF INVENTION

The present invention relates to a punching bag, and more particularly, the present invention relates to a robotic punching bag.

BACKGROUND

A punching bag is a popular training aid in martial arts and combat sports to learn and improvise punching, kicking, and similar striking maneuvers. The punching bag is typically a durable long cylindrical bag hung from a ceiling or any vertical support. The bag can be filled with materials of variable thickness, such as sand. The choice of filling material may depend upon the desired sturdiness of the punching bag and type of training. The bag is freely hung and can take repeated and constant strikes. However, the effectiveness of known punching bags is limited. The punching bags are inanimate and the only movement in a punching bag is back and forth by the impacts, which is anticipated by the trainee. Thus, a need is appreciated for a novel punching bag that has all the advantages of a known punching bag but is devoid of the drawbacks or shortcomings of the known punching bags.

Hereinafter, the terms "trainee" and "user" are interchangeably used and refer to a person practicing or wish to practice/train with the robotic training apparatus.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a robotic training apparatus that allows trainee to improve their defensive skills.

It is another object of the present invention that the robotic training apparatus aids in improving combat skills.

It is still another object of the present invention that the robotic training apparatus helps to learn new combat techniques.

It is yet another object of the present invention that the performance of the trainee over time can be evaluated.

It is still a further object of the present invention that the robotic training apparatus can provide personalized or customized training.

It is yet a further object of the present invention that a user or trainee can train in the absence of a coach.

It is an additional object of the present invention that the robotic training apparatus can be adjusted in height.

It is still an additional object of the present invention that the robotic training apparatus is economical to manufacture.

In one disclosed is a

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
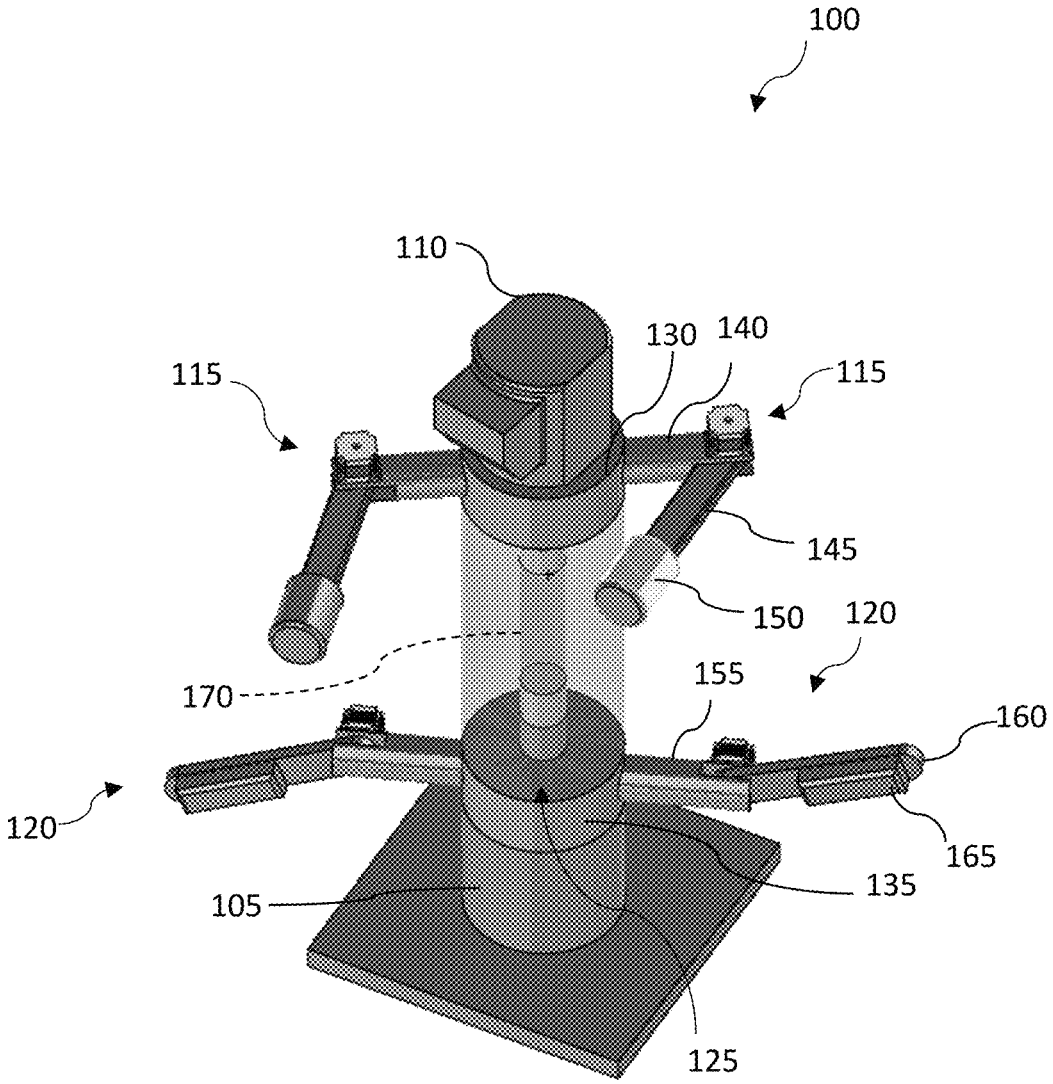
FIG. 1 is a perspective view of a robotic training apparatus for punching and kicking practice, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Disclosed is a robotic training apparatus that can be used by a trainee to learn and improvise combat skills and new techniques. The disclosed robotic training apparatus can be used to practice kicking, punching, and other striking skills. Particularly, the disclosed robotic training apparatus can allow learning defensive skills without the need of a coach or a partner. The users/trainees can switch between different training programs according to their needs, timings, schedules, and desires. The robotic training apparatus can be economical and versatile in that it can be used by pro-athletes and ordinary people. The same apparatus can be adjusted for users/trainees of different ages by increasing or decreasing the height of the apparatus. The disclosed apparatus can imitate the fighting styles or movements of different fighters in throwing the punches and/or kicks. The robotic training apparatus can be of dimensions like a standard punching bag that can be hung at different heights. Moreover, a frame can be used to sandwich the robotic training apparatus between the top and bottom, for mounting the apparatus on a floor. The robotic training apparatus can be interactive with the trainee by tracking his movements. The disclosed robotic training apparatus can track the training schedule, progress, errors in techniques, improvements, tricks, and tips to improvise the skills and techniques, and others. The disclosed robotic training apparatus can be made for either punching practice or both the punching and kicking practice, and both aspects are within the scope of the present invention.

Referring to FIG. 1, which shows one exemplary embodiment of the robotic training apparatus 100 of dimensions like a standard punching bag. The robotic training apparatus can be mounted to a floor or hung from a ceiling or mounted to a horizontal support/frame/stand. The robotic training apparatus 100 can include a base 105 and head 110. The base 105 can support the robotic training apparatus 100 mounted on the floor and the head 110 can support the robotic training apparatus 100 hung from the horizontal support or ceiling. The robotic training apparatus 100 can include a pair of robotic arms 115 and a pair of robotic legs 120. Both the pair of robotic arms and the pair of robotic legs extend horizontally and outwardly from an upstanding body 125 of the robotic training apparatus 100. The body 125 can be upstanding between the base 105 and the head 110. The body 125 of the robotic training apparatus 100 can include an upper revolving member 130 at the top and a lower revolving member 135 at the bottom, those can revolve along a central vertical axis of the robotic training apparatus 100. The pair of robotic arms can extend outwardly and horizontally from the upper revolving member 130 and the pair of robotic legs extend outwardly and horizontally from the lower revolving member 135. The pair of robotic arms 115 can be fixedly coupled to the upper revolving member 130 and rotate with the upper revolving member 130. The pair of robotic legs 120 can be fixedly coupled to the lower revolving member 135. Each robotic arm of the pair of robotic arms can include an upper extension member 140 and an upper striking member 145. The upper extension member 140 can be coupled to the upper striking member 145 through a pivoting joint, such as the upper striking member can rotate with the upper extension member and further pivots in a direction of the rotation of the upper extension member. In one exemplary embodiment, the upper extension member and the upper striking member can rotate in the same plane. The rotation of the upper revolving member and thus the upper extension member and further pivoting of the upper striking member relative to the upper extension member resembles a punching-like action. The upper striking member can be provided with suitable cushioning member 150 that can absorb the impact of the hand and prevent injury to the hands. It is understood that more than one upper extension member can form the robotic arm and multiple joints can join the more than one upper extension member. More than one upper extension member can be of different lengths. The joints can be articulating joints that can have more than one freedom of axis. Each robotic arm of the pair of robotic arms by using multiple extension members and joints can have multiple degrees of freedom.

Similarly, each robotic leg of the pair of robotic legs 120 can have a lower extension member 155 that extends from the lower revolving member 135. To another end of the lower extension member 155 can be coupled a lower striking member 160 that can pivot up and down in a longitudinal plane. The lower extension member 155 can be rotated clockwise and anticlockwise in the traverse plain by the lower revolving member 135. The lower extension member 155 can in turn rotate the lower striking member 160 which can additionally pivot up and down simultaneously with rotation. The rotating and pivoting movements of the lower striking member 160 can resemble a kicking-like action in combat sports. The lower striking member 160 can be provided with a lower cushioning member 165 to absorb the impacts of kicks and to prevent any injury to the leg of the user. It is understood that more than one lower extension member can be incorporated, and the multiple lower extension members can be joined by multiple joints for the multiple degrees of freedom.

A lifting mechanism 170 can mount the upper revolving member 130 and the lower revolving member 135 to the head 110 and the base 105 respectively. The upper revolving member 130 and the lower revolving member 135 can move up and down independent of each other. For example, the lower revolving member 135 can move upwards while the upper revolving member 130 can remain stationary. Similarly, the only upper revolving member 130 can move upwards while the lower revolving member 135 remains stationary. In one case, the upper revolving member 130 and the lower revolving member 135 can move up and down in opposite directions. It is to be noted that the movements of the striking members of the pair of robotic arms and the pair of robotic legs are independent i.e., the upper striking members of the pair of robotic arms can move independently from each other. Similarly, the lower striking members of the pair of robotic legs can move independently from each other. The rotation of the lower revolving member can be independent of the rotation of the upper revolving member. In one exemplary embodiment, the body 125 can be filled with granular material like a punching bag, wherein the user can strike on the body 125 with his hands and legs for practicing like the practicing with a sand-filled punching bag. Alternative to the sand-filled punching bag can be cushion padding incorporated on the body or the frame that can be punched and/or kicked for practicing.

Figure 2:
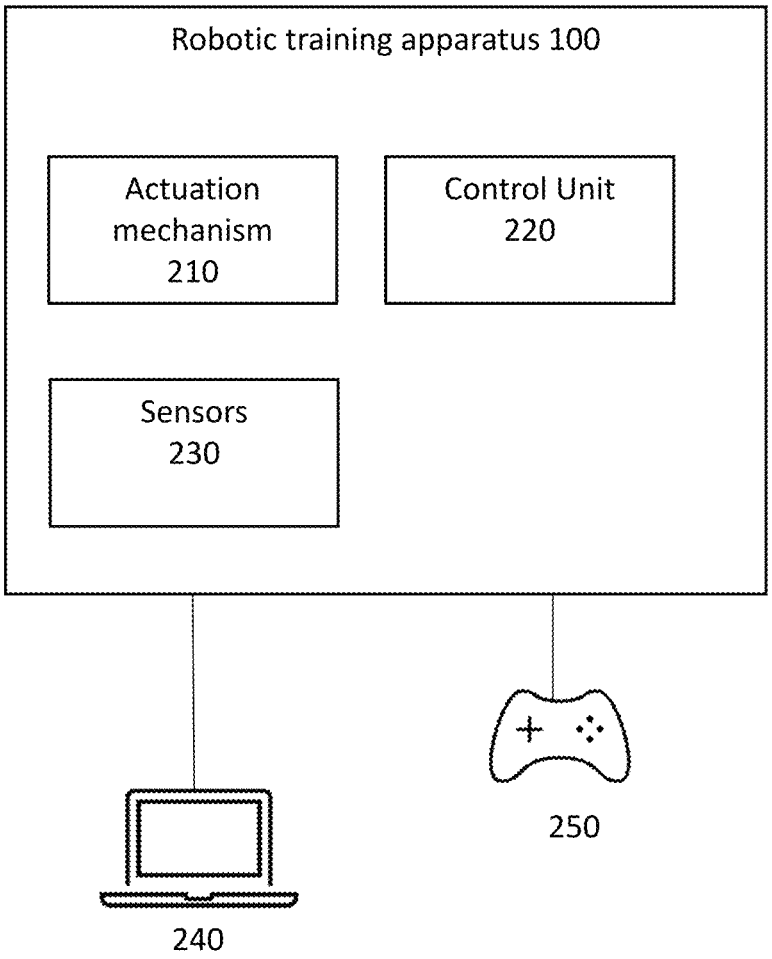
FIG. 2 is a block diagram showing an exemplary embodiment of the robotic training apparatus according to the present invention.

Referring to FIG. 2, the disclosed robotic training apparatus 100 can include an actuation mechanism 210 that can include motors, lifting mechanism 170, shaft, and the like to move the different components including the upper revolving member, the lower revolving member, and the striking members. In one case, each joint of the robotic arm and the robotic leg can be actuated independently to simulate different combat techniques and patterns. A solid frame made from a durable material, such as metals can form a skeleton of the robotic training apparatus 100. The robotic training apparatus 100 can further include a control unit 220 that can control the functioning and movements of different components of the robotic training apparatus 100. The control unit 220 can include suitable network circuitry for wired or wireless connection with an external computing device 240. The control unit 220 can receive various instructions, programs, and configurations from an external computing device 240. The control unit can also be coupled to remote control 250, such as a game controller. The control unit 220 can also send data to the external computing device 240, such as the data sensed by the sensors 230. It is understood that FIG. 2 shows only one external computing device, however, the control unit can communicate with more than one external computing device. The control unit 220 can include appropriate software that allows different training modes to choose from. The software and multiple actuators can make complex punching motions, such as hooks, jabs, crosses, uppercuts, and similar techniques known in the art of combat sports. Similarly, the lower revolving member and the strike members of the pair of robotic legs can make complex kicking motions.

The external computing device can also be provided with application software that can be installed in the external computing device. For example, the external computing device can be a smartphone, laptop, desktop, tablet computer, and the like. The application software can be made available through a distribution service provider, for example, Google Play™ operated and developed by Google, the app store by Apple™, Microsoft store by Microsoft™. In addition to the application software, a website-based interface can also be provided through the world-wide-web. The application software can also be provided for the desktop environment, such as Windows™, Linux, and macOS. The application software can also be provided in a distribution media, such as a memory stick or compact disk. The application software on the external computing device can provide an interface for interacting with the robotic training apparatus. It is understood that the robotic training apparatus can simultaneously connect with more than one external computing device. The control unit 220 can also include network circuitry for connecting to an external network, such as a wireless or wired network for connecting to external computing devices. The application software on the external computing device can provide an interface for the user to interact with the robotic training apparatus. Through the interface, the user can view instructions, videos, and like content for the training. Live sessions can also be conducted through interface with professionals and coaches remotely. The user can also view recorded training sessions. In certain implementations, the user can watch a video of the combat technique and physically practice the same technique with the robotic training apparatus. The robotic training apparatus can also annotate the training video to emphasize the areas based on the physical practice with the user, the areas in which the trainee needs to improvise more.

In certain embodiments, different sensors 230 can be provided that can detect and measure power, hand velocity and force, accuracy, and like parameters known to a skilled person for evaluating the combat training. Additionally, sensors can also be provided on the legs, foot, gloves, arms, and like places on the user or accessories worn by the user. The accessories can be in the form of a neckband, headband, helmet, gloves, shoes, necklace, rings, watch, and the like that can be worn comfortably by the trainee. Sensors can be RFID sensors, proximity sensors, motion sensors, and like such that the robotic training apparatus can know the spatial location and movements of the body parts, including the upper and lower limbs of the trainee.

In certain embodiments, the robotic training apparatus can be maneuvered manually by a controller. For example, game controllers are known in the art, and any such game controller can be used to maneuver the robotic training apparatus. The robotic training apparatus can also be remotely controlled. Thus, two trainees can fight each other while being far from each other and virtually through the robotic trainee apparatus.

Figure 3:
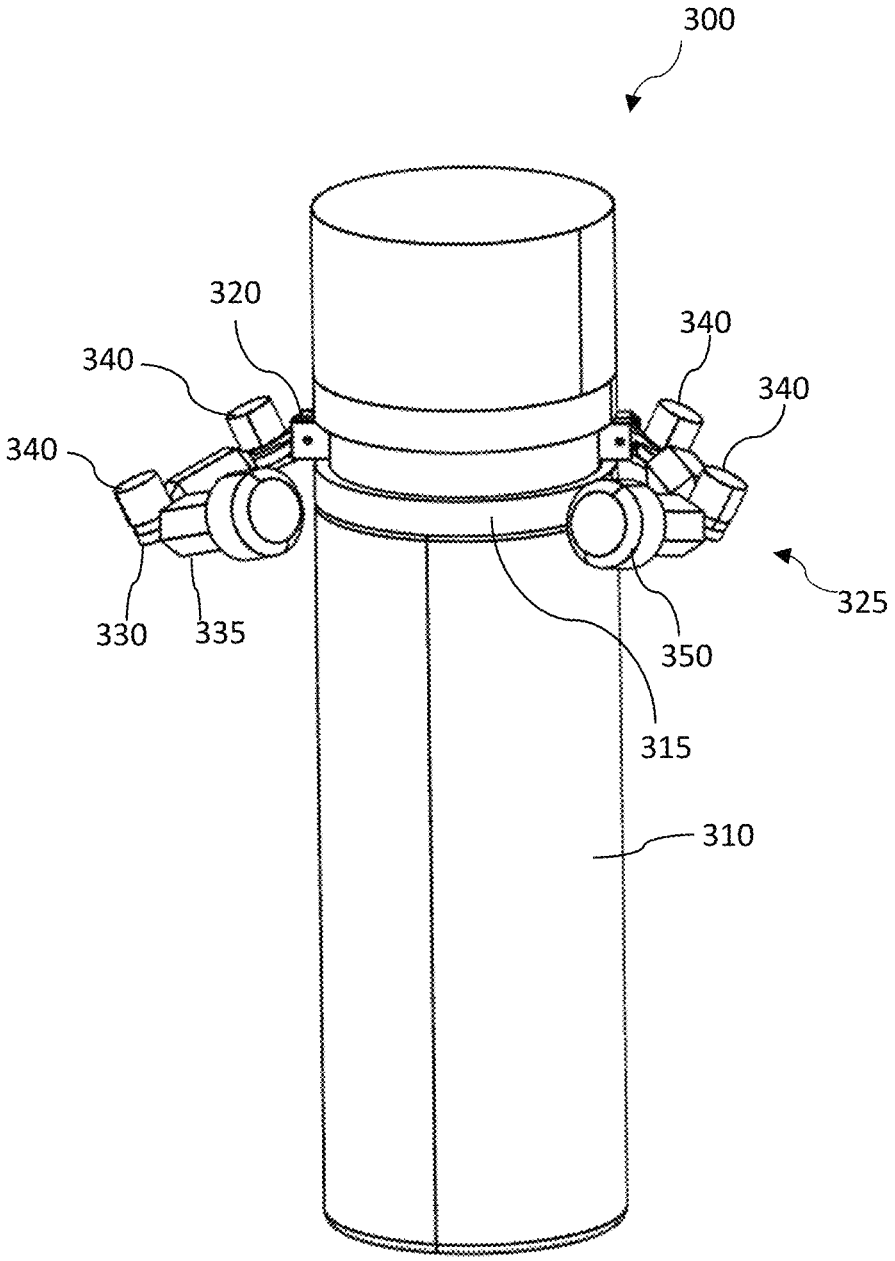
FIG. 3 is a perspective view of another exemplary embodiment of the robotic training apparatus for punching practice, according to the present invention.

Referring to FIG. 3 which discloses another exemplary embodiment of the robotic training apparatus 300 which can only have the robotic arms 325. FIG. 3 shows the robotic training apparatus 300 with a cover 310 covering most of the robotic training apparatus 300. Two robotic arms 325 can be seen extended outwards from a revolving member 315. Each of the robotic arm 325 can include multiple extension members 335 that connect to the revolving member 315 through articulating joints 320. A striking member 350 can be coupled to a terminal extension member i.e., the extension member at end of the extension members. Both the extension member and the striking member can be provided with suitable cushioning to prevent any injury to the hand of the trainee while practicing. The striking member 350 can have additional padding resembling a hand-fighting glove. The extension members can be coupled to each other through joint 330 and the first extension member can be coupled to the revolving member 315 through joint 320. Also, it can be seen in FIG. 3 are the multiple stepper motors 340 each operably coupled to the joints 330 of the robotic arm. Each joint of the robotic arm 325 can be independently actuated to resemble a natural punching action as well as simulate a range of combat techniques. In one implementation, the tooth of the stepper can be attached to one piece and the motor can be attached to the other piece at the joint. As the stepper turns, the attached piece will turn as well. All the motors are attached to the same control unit that controls the operation of the actuation mechanism and the motors to simulate the desired movement. For example, 30 degrees stepper, 45 degrees stepper, and 25 degrees stepper.

Figure 4:
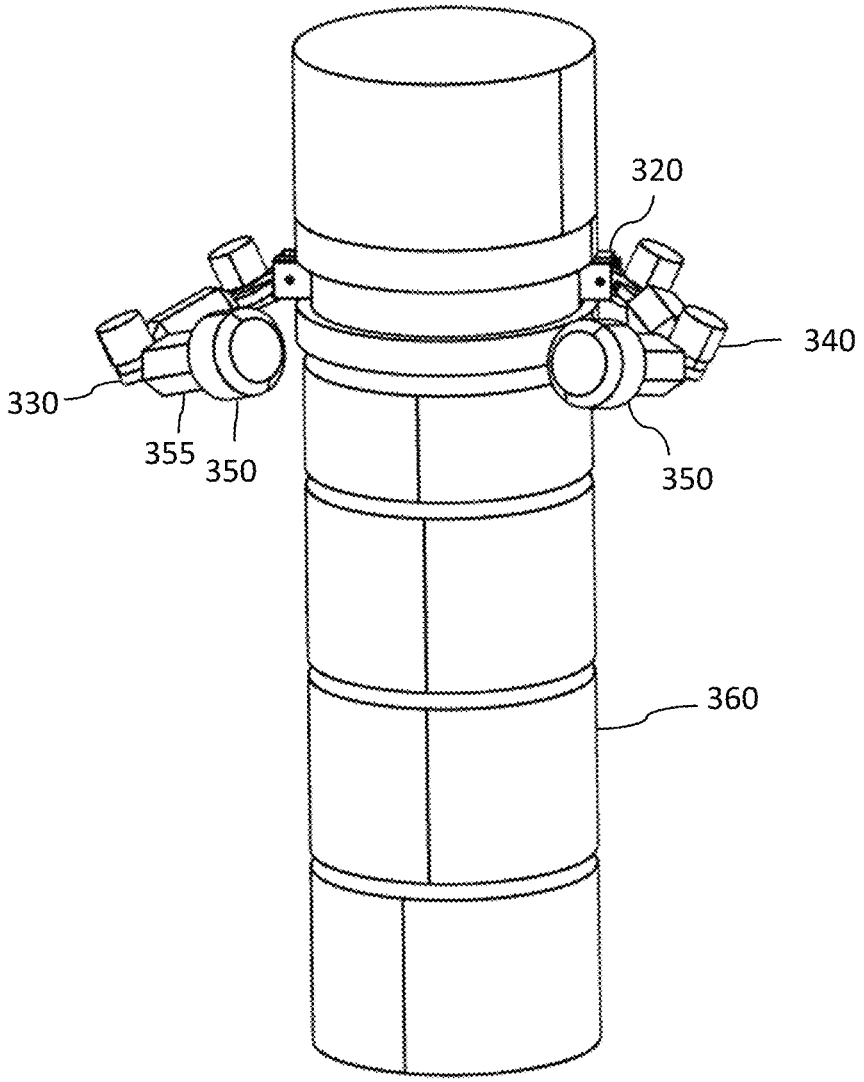
FIG. 4 shows the robotic training apparatus as in FIG. 3 without cover illustrating the pads, according to an exemplary embodiment of the present invention.
Figure 5:
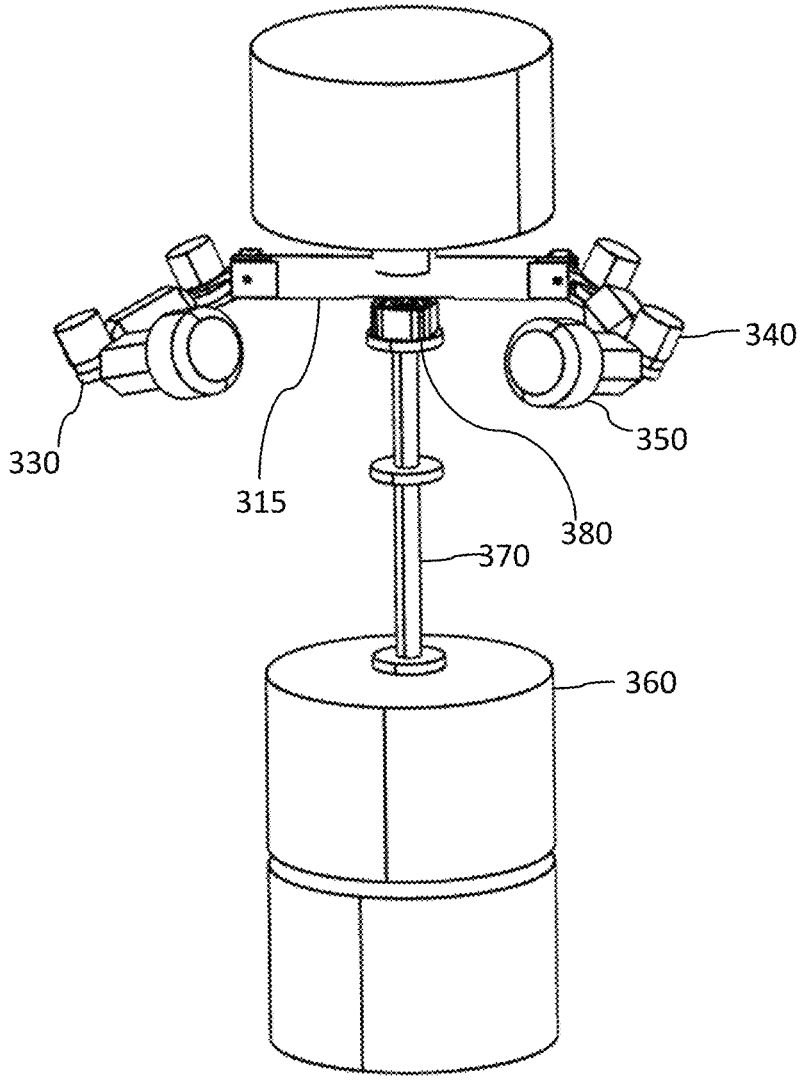
FIG. 5 shows the robotic training apparatus as in FIG. 3 without cover illustrating the pads, according to an exemplary embodiment of the present invention.
Figure 6:
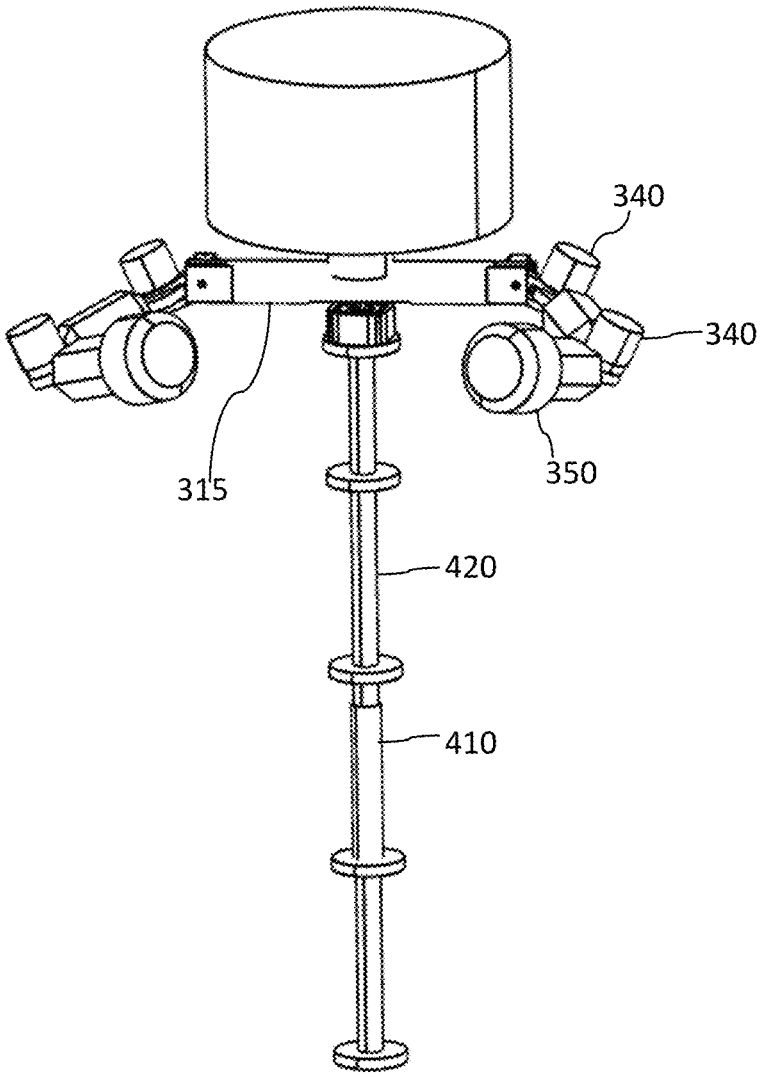
FIG. 6 shows the robotic training apparatus having the paddings removed to illustrate the frame, according to an exemplary embodiment of the present invention.

Referring to FIG. 4 which shows the robotic training apparatus 300 with the cover 310 removed to illustrate the cushioning pads 360. The cushioning pads allow the robotic training apparatus 300 to be punched for practicing like a punching bag. FIG. 5 shows the robotic training apparatus 300 with the cushioning pads 360 removed to illustrate the vertical frame 370 and the revolving member 315. Referring to FIG. 6, the vertical frame 370 can include the telescoping frame members 420 and 410 that may allow increasing and decreasing the height of the revolving member 315.

In certain embodiments, the disclosed robotic training apparatus can be used by all age groups, pro athletes, and ordinary people that just want to get in shape and be fit. Novice users can learn the art of combat sports and martial skills and can also improve their defensive skills at their own pace and in the privacy of their homes with or without any external aid from a coach. The users can be provided with new videos of new training exercises by fitness professionals. Workers who have no fixed dedicated time for professional training from coaches or experts can easily learn in the privacy and comfort of their homes. The disclosed robotic training apparatus can provide a gamified training environment that users can enjoy, especially the kids. Users can work out anytime and pause in between, take a break, and can save heavily on training costs. Pro fighters can extremely benefit from the robotic training apparatus that can improvise their skills and learn new techniques.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A robotic training apparatus for martial arts and combat sports, the robotic training apparatus comprising:

an upstanding frame;

a revolving member mounted to the frame, the revolving member configured to revolve clockwise and anticlockwise along a central vertical axis, the revolving member coupled to an actuation mechanism and a control unit; and a pair of robotic arms, each robotic arm of the pair of robotic arms comprises:

one or more extension members that extend horizontally and outwardly from the revolving member, a striking member operably coupled to a terminal extension member of the one or more extension members, and a plurality of joints operably coupling the one or more extension members, the revolving member, and the striking member, wherein the plurality of joints coupled to the actuation mechanism and the control unit, wherein, the control unit and the actuation mechanism are configured to actuate the revolving member and the pair of arms to simulate a pre-programed punching training session.

2. The robotic training apparatus according to claim 1, wherein the striking member is implemented with cushioning pads.

3. The robotic training apparatus according to claim 2, wherein the one or more extension members are provided with cushioning pads.

4. The robotic training apparatus according to claim 1, wherein the actuation mechanism is further configured to increase or decrease a height of the revolving member from a base of the frame.

5. The robotic training apparatus according to claim 1, wherein the actuation mechanism comprises stepper motors coupled to each joint of the plurality of joints and to the revolving member.

6. The robotic training apparatus according to claim 1, wherein the control unit is configured to present a training video on an external computing device through an interface implemented on the external computing device.

7. The robotic training apparatus according to claim 1, wherein the robotic training apparatus further comprises a plurality of sensors configured to be worn by a user practicing with the robotic training apparatus, wherein the control unit is configured to detect spatial body movements of the user through the plurality of sensors for an interactive training session.

8. The robotic training apparatus according to claim 7, wherein the pre-programed punching training session comprises simulating a training session between a trainee and a coach.

9. The robotic training apparatus according to claim 7, wherein the control unit is further configured to couple to a remote control configured to control one or more functions of the robotic training apparatus.

10. The robotic training apparatus according to claim 1, wherein the robotic training apparatus further comprises a plurality of cushion pads mounted to the frame forming a body, wherein the body configured to receive punches and kicks for practicing.

11. A method for practicing punching technique in martial arts and combat sports, the method comprises the steps of:

providing a robotic training apparatus comprising:

an upstanding frame, a revolving member mounted to the frame, the revolving member configured to revolve clockwise and anticlockwise along a central vertical axis, the revolving member coupled to an actuation mechanism and a control unit, and a pair of robotic arms, each robotic arm of the pair of robotic arms comprises:

one or more extension members that extend horizontally and outwardly from the revolving member, a striking member operably coupled to a terminal extension member of the one or more extension members, and a plurality of joints operably coupling the one or more extension members, the revolving member, and the striking member, wherein the plurality of joints coupled to the actuation mechanism and the control unit, wherein, the control unit and the actuation mechanism are configured to actuate the revolving member and the pair of arms simulating a pre-programed punching training session; and conducting the pre-programmed training session by the robotic training apparatus with a trainee.

12. The method according to claim 11, wherein the method further comprises the steps of:

presenting a training video to the trainee through an interface implemented on an external computing device.

13. The method according to claim 11, wherein the robotic training apparatus further comprises a plurality of sensors configured to be worn by the trainee, wherein the control unit is configured to detect spatial body movements of the trainee through the plurality of sensors for an interactive training session, wherein the method further comprises the steps of:

wearing the plurality of sensors by the trainee.

14. The method according to claim 13, wherein the plurality of sensors is incorporated in a neckband, wherein the neckband is worn by the trainee.

15. The method according to claim 13, wherein the robotic training apparatus further comprises a plurality of cushion pads mounted to the frame forming a body, wherein the body configured to receive punches and kicks for practicing, wherein the method further comprises the steps of:

punching the body of the robotic training apparatus by the trainee.

16. The method according to claim 15, wherein the method further comprises the steps of:

actuating the revolving member and the pair of arms to strike a punch towards the trainee based on the pre-programmed training session; and tracking by the control unit through the plurality of sensors worn by the trainee, body movements of trainee defending the strike.

17. A robotic training apparatus for martial arts and combat sports, the robotic training apparatus comprising:

an upstanding body;

an upper revolving member mounted in an upper portion of the upstanding body, the upper revolving member configured to revolve clockwise and anticlockwise along a central vertical axis, the upper revolving member coupled to an actuation mechanism and a control unit;

a lower revolving member mounted to a lower portion of the upstanding body, the lower revolving member configured to revolve clockwise and anticlockwise along the central vertical axis, the lower revolving member coupled to the actuation mechanism and the control unit;

a pair of robotic arms, each robotic arm of the pair of robotic arms comprises:

an upper extension member that extends from the upper revolving member, and an upper striking member pivotally coupled to the upper extension member, the upper striking member operably coupled to the actuation mechanism and the control unit; and a pair of robotic legs, wherein each robotic leg of the pair of robotic legs comprises:

a lower extension member that extends from the lower revolving member, and a lower striking member pivotally coupled to the lower extension member, wherein the lower striking member operably coupled to the actuation mechanism and the control unit.

18. The robotic training apparatus according to claim 17, wherein the body is filled with a cushioning material.

* * * * *